United States Patent [19]

Hasircoglu

[11] Patent Number: 4,605,276

[45] Date of Patent: Aug. 12, 1986

[54] TWO ROW COAXIAL CABLE CONNECTOR

[75] Inventor: Alexander W. Hasircoglu, Lancaster, Pa.

[73] Assignee: E. I. Du Pont de Nemours and Company, Wilmington, Del.

[21] Appl. No.: 716,515

[22] Filed: Mar. 26, 1985

Related U.S. Application Data

[63] Continuation of Ser. No. 480,594, Mar. 30, 1983, abandoned.

[51] Int. Cl.[4] ..... H01R 13/50

[52] U.S. Cl. ..... 339/176 MF; 339/196 M; 339/177 R; 339/14 R

[58] Field of Search ..... 339/177 R, 177 E, 103, 339/107, 176 MF, 17 F, 126 RS, 65

[56] References Cited

U.S. PATENT DOCUMENTS

| | | | |
|---|---|---|---|
| 3,550,066 | 12/1970 | Cootes | 339/107 |
| 3,864,010 | 2/1975 | Vasserlein, Jr. | 339/107 |
| 3,963,319 | 6/1976 | Schumacher et al. | 339/176 MF |
| 4,035,050 | 7/1977 | Volinskie | 339/99 |
| 4,040,704 | 8/1977 | Huber | 339/176 MF |
| 4,163,598 | 8/1979 | Bianchi et al. | 339/107 |
| 4,225,295 | 6/1976 | Sinclair et al. | 339/176 MF |
| 4,269,466 | 5/1981 | Huber | 339/107 |
| 4,327,956 | 5/1982 | Sitzler | 339/107 |
| 4,352,531 | 10/1982 | Gutter | 339/14 R |

FOREIGN PATENT DOCUMENTS

| | | | |
|---|---|---|---|
| 0076657 | 4/1983 | European Pat. Off. | 339/126 RS |

*Primary Examiner*—Gil Weidenfeld
*Assistant Examiner*—David L. Pirlot

[57] ABSTRACT

A two row coax cable connector having an interior and exterior housing. The interior housing contains two rows of entrance openings for receiving drain wires in one row and signal wires in the other row. The interior housing also has two rows of exit slots for receiving an electrical terminal capable of terminating the drain wires in one row and the signal wires in a second row. The exterior housing encloses the interior housing and has a latch opening for engaging a latch from a strain relief member.

6 Claims, 4 Drawing Figures

TWO ROW COAXIAL CABLE CONNECTOR

This application is a continuation of application Ser. No. 480,594 filed Mar. 30, 1983, now abandoned.

FIELD OF THE INVENTION

This invention relates to electrical connectors used with coaxial cable. More particularly, it refers to a two row connector for shielded coaxial ribbon cable having a single signal and at least one drain wire in repeating sequence.

BACKGROUND OF THE INVENTION

Recent improvements in the development of processes for making coaxial cable such as set forth in U.S. Pat. No. 4,187,390 have created a need for connectors of advanced design to provide means of terminating these new coaxial cables. The coaxial cables are the type comprising an inner conductor, an insulating jacket of porous poly(tetrafluoroethylene) tape, at least one drain wire adjacent the insulating jacket and an outer metallic shield. A dielectric covering, usually polyvinyl chloride (PVC), encloses the metallic shield.

Electrical coaxial cable connectors known to the art such as set forth in U.S. Pat. Nos. 3,864,001, 3,963,319, 3,954,321, 3,958,852, 4,035,050, 4,040,704, and 4,169,650 will not easily and cheaply terminate cables such as described in the aforementioned U.S. Pat. No. 4,187,390.

SUMMARY OF THE INVENTION

I have now designed an improved double row coaxial cable connector providing a pluggable interface between a printed circuit board or other electrical connection and a coaxial ribbon cable. My design encompasses an inner housing having two rows of entrance openings such that one row accommodates the coaxial cable drain wires and the other row accommodates the signal wires. The wires are led through openings into a conical-shaped channel and through the smallest end of that channel to engage an electrical terminal located in an exit portion of the interior housing. The exit portion of the housing has two rows of terminals, one row accommodating the drain wires and the second row accommodating the signal wires. The drain and signal wires are terminated on a first end of their respective terminals. The second end of the terminal is available for engagement with other electrical devices such as pins.

The interior housing is slidably engaged within an exterior housing. The exterior housing has latch openings for receiving latch members on a strain relief device. The strain relief device grips the coaxial cable adjacent to the entrance opening to the interior housing.

BRIEF DESCRIPTION OF THE DRAWINGS

The present invention may be best understood by those having ordinary skill in the art by reference to the following detailed description when considered in conjunction with the accompanying drawings in which.

DESCRIPTION OF THE INVENTION

Figure 1:
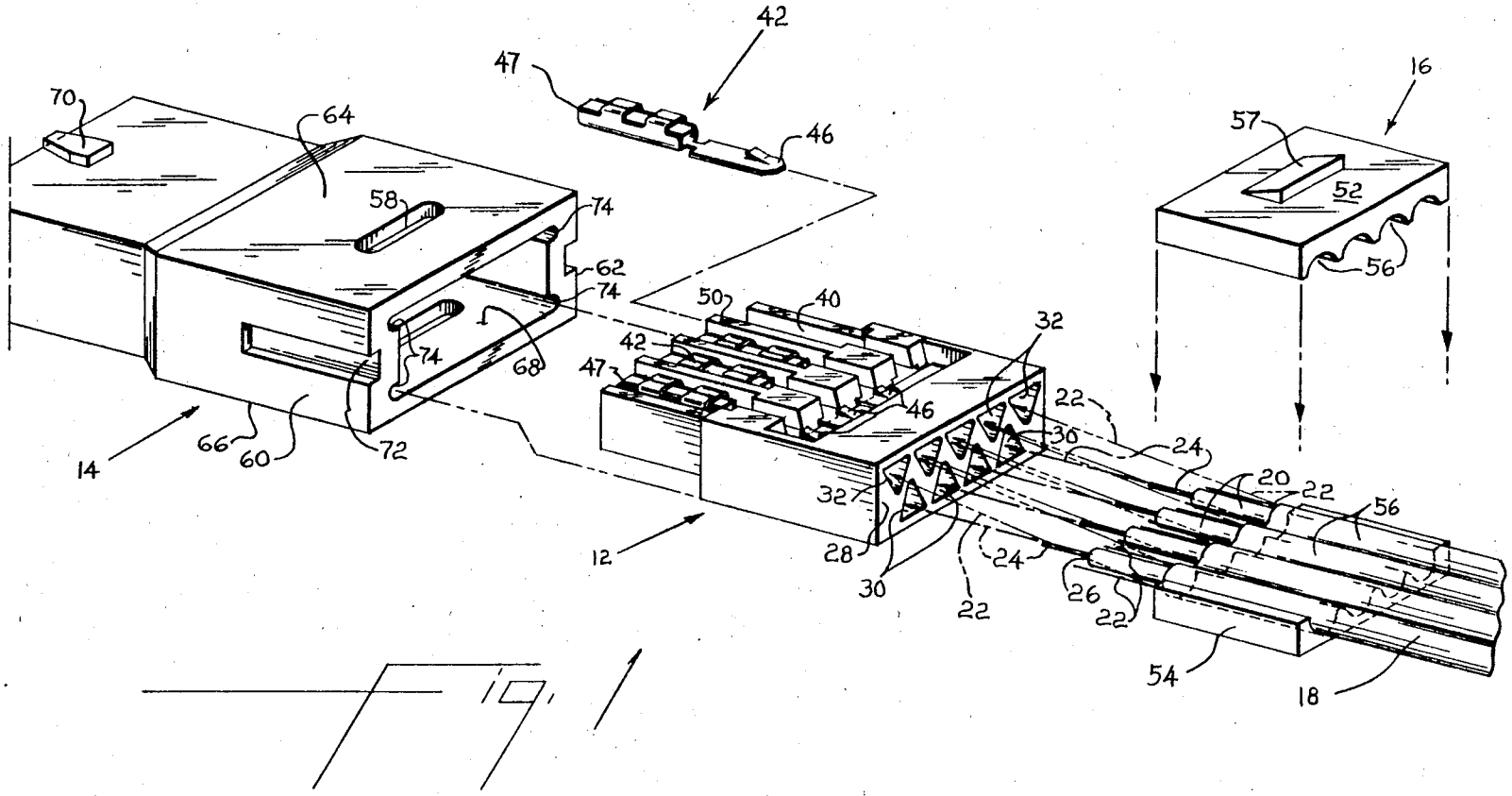
FIG. 1 is an exploded perspective assembly of the connector.
Figure 3:
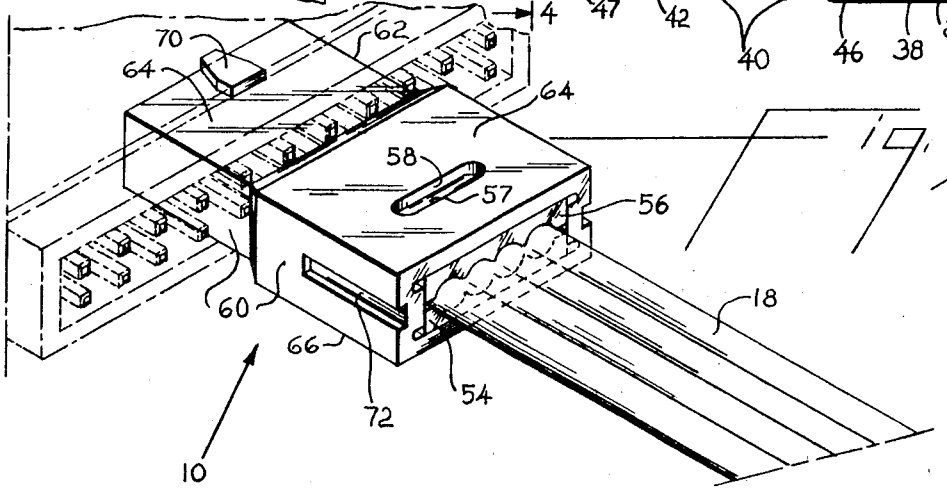
FIG. 3 is a perspective view of the connector having all its parts joined together.

Referring first to FIGS. 1 and 3, the connector 10 comprises an inner housing 12, an exterior housing 14 and a strain relief member 16. The coaxial cable 18 comprises multiple repeating jackets 20 with drain wires 22 and signal wires 24 associated together. The signal wires 24 are enclosed within a poly(tetrafluoroethylene) jacket 26 and the drain wires 22 are on each side of the jacket. The entrance end 28 of the interior housing 12 receives the signal wires through openings 30 and the drain wires through openings 32.

Figure 2:
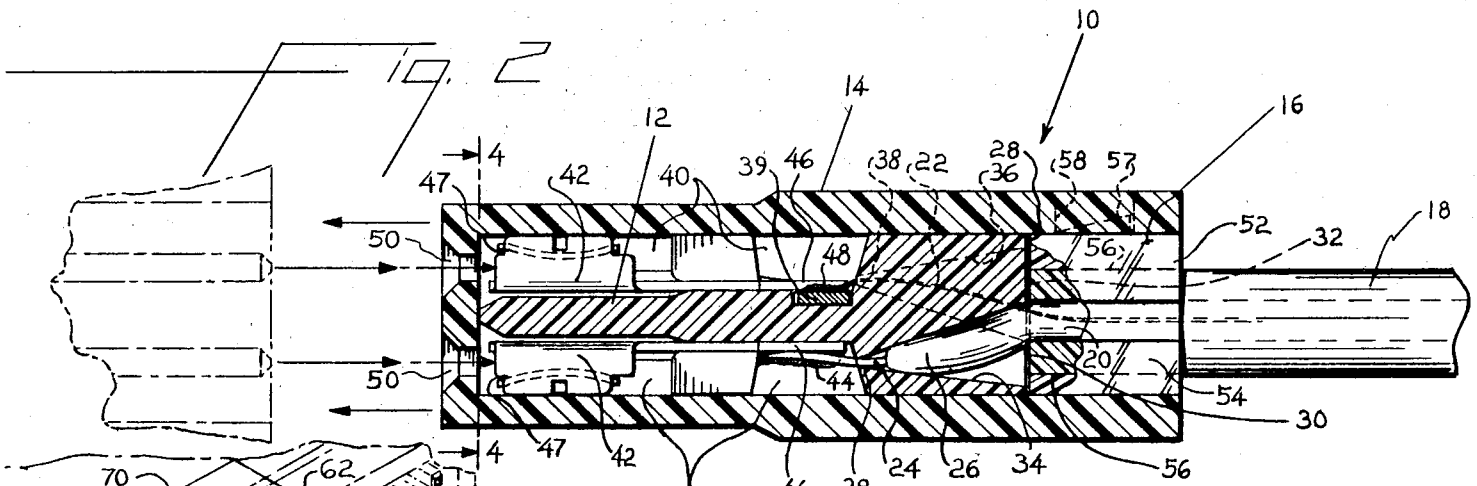
FIG. 2 is an elevational view in cross section of the interior housing.
Figure 4:
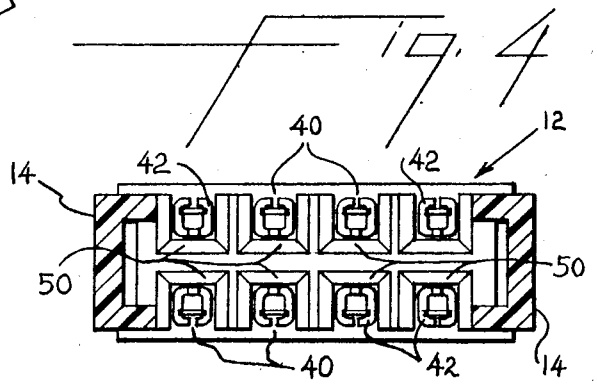
FIG. 4 is an end view of the interior housing along line 4—4 of FIG. 2.

In FIG. 2, one can note a conical-shaped channel 34 receiving the signal wire 24 from opening 30 and another conical-shaped channel 36 receiving the drain wire 22 through opening 32. The wires pass through the smallest opening 38 of the conical-shaped channels 34 or 36 and enter into an open slot 40 retaining an electrical terminal 42. The signal wires 24 are soldered 44 to a first end 46 of terminal 42 and the drain wires are soldered 48 to a buss bar 39 sitting transversely to the terminals 42 in interior housing 12. The buss bar is in electrical contact through the solder joint 48 with the first end 46 of terminal 42. A second end 47 of terminal 42 is available for another electrical termination such as a conductive pin as seen in FIG. 2.

An exit end 50 of the interior housing 12 comprises two rows of the open slots 40 retaining the terminals 42.

The coax cable 18 is held in place by strain relief 16 having shell halves 52 and 54. These shell halves have interior scallop ridges 56 enclosing individual repeating units 20 of the coax cable 18. The exterior surface of the strain relief 16, both in shell halves 52 and 54, have ramp-shaped latches 57 capable of engaging a latch opening 58 in the exterior housing 14. The shell halves 52 and 54 are held together by a PVC pipe cement compatible with the PVC outer coating of cable 18.

The exterior housing 14 has sidewalls 60 and 62, top member 64 and bottom member 66 enclosing a central cavity 68.

A slidable motion engages the interior housing within the cavity 68. The latch members 57 in strain relief 16 engage within the latch openings 58 of exterior housing 14 to retain both the strain relief 16 and interior housing 12 within the exterior housing 14. Latch 70 on exterior housing 14 is optionally available for engagement with the cabinet of an electronic device such as a computer, television or radio.

The interior and exterior housing and strain relief shells are each made from a one piece molded dielectric. The interior housing is made from a high heat resistant plastic such as polyphenylene sulphide. The exterior housing can be polycarbonate or nylon and the strain relief, polyvinylchloride. The terminal can be any conductive material such as bronze, phosphor bronze, copper, or like conductive metal.

The coax cable 18 is prepared for connector 10 by stripping the ends to expose the poly(tetrafluoroethylene) jackets 20. The drain wires 22 are guided to the openings 32 and the signal wires within the jacket 20 are guided into openings 30. The conical shape of the channel 34 pushes back the poly(tetrafluoroethylene) jacket covering the signal wire and allows the signal wire to become exposed within the conical shaped channel 34. The poly(tetrafluoroethylene) is pushed back and the signal wire is pushed through opening 38 so that contact can be made with terminal 42 at contact point 46. The signal wires are preferably soldered 44 to the terminals 42. However, other means of terminating to the terminals well known to those skilled in the art can be substituted.

The forgoing detailed description has been given for clearness and understanding only and no unneccessary limitations should be understood therefrom as some modifications may be obvious to those skilled in the art.

Having thus described my invention, what is claimed and desired to be secured by Letters Patent is:

1. An electrical connector for coax cable having repeating units of a poly(tetrafluoroethylene) jacket surrounding a central signal conductor and at least one drain wire exterior to the jacket, the connector comprising an interior dielectric housing and an exterior dielectric housing, the interior housing containing entrance and exit ends, the ends separated by channels for guiding and receiving signal and drain wires and slots for retaining electrical terminals, the entrance end having two rows of openings, one above the other, leading into conical shaped channels, said channels engaging and pushing back the jacket surrounding the signal conductor as the cable is inserted, one row receiving a signal wire surrounded by the poly(tetrafluoroethylene) jacket in each opening and the other row receiving at least one drain wire in each opening, the exit end having two rows of open slots, one above the other, each slot containing an electrical terminal having a first and second contact end, one row of terminals terminating the drain wires and the other row terminating the signal wires free of the jacket at the first end, the second end being available for another electrical termination, the exterior housing having two upright side walls joined to two horizontal top and bottom members enclosing a cavity of sufficient dimension to slidably engage and retain the interior housing.

2. An electrical connector according to claim 1 wherein the interior housing entrance end openings are triangle shaped.

3. The electrical connector according to claim 1 wherein the electrical terminal second end terminates an electrically conductive pin.

4. The electrical connector according to claim 1 wherein a strain relief member encloses the coax cable adjacent the entrance end of the interior housing.

5. The electrical connector according to claim 4 wherein the strain relief member comprises two shell halves having interior and exterior surfaces, the interior surfaces having multiple scallop shaped ridges for retaining repeating units of the coax cable and the exterior surfaces having a ramp shaped latch for engaging a latch opening in the exterior housing.

6. The electrical connector according to claim 5 wherein the two shell halves are held together with a cement compatible with the coax cable.

* * * * *